US006361448B1

(12) United States Patent
McKeon

(10) Patent No.: US 6,361,448 B1
(45) Date of Patent: Mar. 26, 2002

(54) APPARATUS AND METHOD FOR CONTROLLING AND STABILIZING THE SWING MECHANICS OF A GOLFER

(76) Inventor: Brian P. McKeon, 234 E. Main St., Georgetown, MA (US) 01833

( * ) Notice: Subject to any disclaimer, the term of this patent is extended or adjusted under 35 U.S.C. 154(b) by 0 days.

(21) Appl. No.: 09/472,965

(22) Filed: Dec. 28, 1999

(51) Int. Cl.[7] ..... A63B 69/36

(52) U.S. Cl. ..... 473/207; 473/215; 602/16; 482/112

(58) Field of Search ..... 473/207, 215, 473/217; 602/16, 23, 26; 128/882, 892; 623/27, 39

(56) References Cited

U.S. PATENT DOCUMENTS

| | | | | | |
|---|---|---|---|---|---|
| 4,088,326 | A | | 5/1978 | Bifulco | |
| 4,433,679 | A | * | 2/1984 | Mauldin et al. | 128/882 |
| 4,733,656 | A | * | 3/1988 | Marquette | 602/26 |
| 4,801,138 | A | * | 1/1989 | Airy et al. | 602/16 |
| 4,938,206 | A | * | 7/1990 | Harris et al. | 128/882 |
| 4,961,416 | A | * | 10/1990 | Moore et al. | 602/26 |
| 5,000,169 | A | * | 3/1991 | Swicewood et al. | 128/882 |
| 5,052,379 | A | * | 10/1991 | Airy et al. | 602/16 |
| 5,188,365 | A | | 2/1993 | Picard | |
| 5,358,468 | A | * | 10/1994 | Longo et al. | 602/16 |
| 5,443,267 | A | | 8/1995 | Thorson | |
| 5,554,104 | A | * | 9/1996 | Grim | 602/23 |
| 5,800,371 | A | * | 9/1998 | Winn | 602/26 |
| 6,074,355 | A | * | 6/2000 | Bartlett | 602/16 |

* cited by examiner

*Primary Examiner*—Mark S. Graham
*Assistant Examiner*—Raeann Gorden
(74) *Attorney, Agent, or Firm*—Fish & Richardson P.C.

(57) ABSTRACT

A novel apparatus and method for controlling and stabilizing the swing mechanics of a golfer is disclosed. More specifically, an apparatus for and method of stabilizing the right knee (the left knee for left handed golfers) of a golfer such that a critical knee flexion angle is maintained throughout the golf swing, the weight of the golfer is properly transferred, and the right hand side (left hand side for left handed golfers) is properly loaded for a reliable, consistent, controlled, and safe golf swing. The apparatus for controlling and stabilizing the swing mechanics of a golfer comprises upper and lower leg support members and an adjustable hinge about the knee flexion axis and that will accommodate variable degrees of flexion depending on golfer specific conditions (e.g. height, arm and leg length, weight, etc.) and environmental conditions (course conditions, ball lie, playing hazards, etc.). The adjustable hinge assembly operates in both a locked position mode that prevents the knee from flexing and an unlocked position mode that permits unrestricted ambulation. The method for controlling and stabilizing the swing mechanics of a golfer comprises selecting an optimum knee flexion angle, locking the knee at the selected angle, approaching the ball in preparation for a golf swing, and swinging the club through all phases of the golf swing (e.g. take-away, impact, and follow-through). The method further comprises unlocking the knee to permit unrestricted ambulation for walking to the next swing position then selecting an additional knee flexion angle (that may be the same or different as the first depending on golfer and environmental conditions) and locking the knee at the selected angle.

23 Claims, 13 Drawing Sheets

APPARATUS AND METHOD FOR CONTROLLING AND STABILIZING THE SWING MECHANICS OF A GOLFER

BACKGROUND OF THE INVENTION

This invention relates to an apparatus and method for controlling and stabilizing the swing mechanics of a golfer. More specifically, this invention relates to an apparatus for and method of stabilizing the right knee (the left knee for left handed golfers) of a golfer such that a critical knee flexion angle is maintained throughout the golf swing, the weight of the golfer is properly transferred, and the right hand side (left hand side for left handed golfers) is properly loaded for reliable, consistent, controlled, and safe golf swings.

Although there are variations of swings in professional and successful golfers, all of their swings obey certain principles that allow for consistent ball striking. The golf swing can be broken down into three basic phases: (1) take-away; (2) impact; and (3) follow-through.

The objective of the take-away phase is to properly load the right side (or the left side for left hand golfers) and set the club at the top of the swing. In this phase, the golfer moves the club head from left to right (vice-versa for left hand golfers) and shifts weight from left to right. A critical aspect of the take-away phase of the golf swing is the maintenance of the right knee flexion angle which prevents unwanted vertical motion and allows for proper loading of the right side. The impact phase of the golf swing consists of pre-impact portion and an impact portion. A critical aspect of this phase of the golf swing is the transfer of the golfers weight during pre-impact from the right side back to the left side for impact. A proper initial weight shift to the right side and preservation of the right knee flexion angle allow for a successful shift to the left side for impact.

Finally, the follow-through phase of the golf swing consists of post-impact and completion of the swing. Proper balance is critical and essential to properly finish the golf swing. Importantly, balance only can be achieved with proper swing mechanics in the first two phases of the swing, i.e. the take-away and impact phases.

It is well known in the art that faulty swing mechanics leads to an increase incidence of injury and results in uncontrolled and misdirected golf shots. A common swing fault producing errant shots in golf is produced by allowing the right knee to extend on the take-away and lose its initial knee flexion angle that is present at ball address. This fault causes the golfers weight to remain on the left side (right side for left handed golfer) while the club is at the top of the golf swing. Hence, on the downswing the weight either transfers to the right side or remains on the left causing a variety of errant shots including fat (striking ground first) and thin (striking only ball and no turf) shots.

Shown in FIGS. 1A and 1B is a golf swing sequence demonstrating a very common error referred to as "reverse pivot." As shown in FIG. 1A, the right knee extends causing the golfer to shift weight to the left side (from A to B) on the take-away. As shown in FIG. 1B, this causes a "reverse pivot" forcing the golfer to go to the right side (from B to A) on the downswing making reproducible contact with the ball virtually impossible. In an ideal and controlled swing, the weight should be predominantly on the left side of the golfer (at B) at the midpoint of the downswing. However, as shown in FIG. 1B, because of the flexion of the right knee and concomitant reverse pivot, the majority of the weight is on the right side (at A).

Other swing faults include right knee lateral sway, vertical motion, excessive lower body motion in the short game, and extra long swings. Right knee lateral sway, like reverse pivot, is a common fault preventing complete turn and loading of the right side. Vertical motion is the rising "up" on the take-away and dropping "down" on the downswing. This swing fault prevents solid club face-ball contact. A major fault with the "short game,") i.e. chipping and putting, is excessive lower body motion during the swing. Even professional golfers devote a significant amount of time trying to resolve the motion problems in the short swing. Finally, there is no question that the current trend in professional golf is to shorten and compact the golf swing. In this regard, many golfers improperly overextend their swing resulting in extra long swings that compromise the ball control associated with short and compact swings.

The prior art devices and methods related to controlling the swing of a golfer have failed to address and resolve the specific concerns noted above. Moreover, although there are a number of golf training devices purporting to address some issues relating to the golf swing, these prior art devices are often unwieldy and include multi-strap hand/leg braces that are uncomfortable and require an unacceptable amount of time to properly adjust and position. In addition, these prior art devices fail to provide a reliable, accurate, and convenient adjustment mechanism that enables a golfer to set the appropriate angle of knee flexion. The prior art has also failed to provide for a method of controlling the swing of a golfer that can be easily and conveniently employed in a round of golf such that a golfer can adjust the angle of knee flexion throughout a round of golf depending on the characteristics of a particular golfer and environmental conditions.

The difficulties and limitations suggested in the preceding are not intended to be exhaustive, but rather are among many which demonstrate that although significant attention has been devoted to controlling the swing of a golfer, the prior art devices and techniques will admit to worthwhile improvement.

OBJECTS OF THE INVENTION

It is therefore a general object of the invention to provide a novel apparatus and method which will obviate or minimize difficulties of the type previously described.

It is another general object of the invention to provide a novel apparatus and method for controlling and stabilizing the swing mechanics of a golfer in order to ensure a reliable, consistent, controlled, and safe golf swing.

It is a specific object of the invention to provide a novel apparatus and method for stabilizing the right knee (the left knee for left handed golfers) of a golfer such that a critical knee flexion angle is maintained throughout the golf swing.

It is another specific object of the invention to provide a novel apparatus and method for controlling the swing of a golfer such that the weight of the golfer is properly transferred during the take-away, impact, and follow-through phases of the golf swing.

It is yet another specific object of the invention to provide a novel apparatus and method for controlling the swing of a golfer such that the right hand side (left hand side for left handed golfers) of the golfer is properly loaded for impact.

It is still another specific object of the invention to provide a novel apparatus and method for controlling the swing of a golfer in order to reduce right knee lateral sway, vertical motion, excess lower body motion during the short game, and extra long swings.

It is still yet another specific object of the invention to provide a novel apparatus for controlling and stabilizing the swing of a golfer that can be easily and conveniently adjusted and positioned on the leg of the golfer during a golf training session or a competitive round of golf.

It is yet another object of the invention to provide for a novel method of controlling the swing of a golfer that can be easily and conveniently employed in a round of golf such that a golfer can adjust the angle of knee flexion throughout the round depending on the particular characteristics of a golfer and environmental conditions.

It is yet another object of the invention to provide for a method of controlling the swing of a golfer that can be easily and conveniently employed in a round of golf such that a golfer can lock his/her knee at a selected and optimum angle of flexion in preparation for a swing and unlock his/her knee to allow unrestricted ambulation for walking to the next swing position.

SUMMARY OF THE INVENTION

A novel apparatus and method for controlling and stabilizing the swing mechanics of a golfer is disclosed. More specifically, an apparatus for and method of stabilizing the right knee (the left knee for left handed golfers) of a golfer such that a critical knee flexion angle is maintained throughout the golf swing, the weight of the golfer is properly transferred, and the right hand side (left hand side for left handed golfers) is properly loaded for a reliable, consistent, controlled, and safe golf swing. The apparatus for controlling and stabilizing the swing mechanics of a golfer comprises upper and lower leg support members and an adjustable hinge assembly that is about the knee flexion axis and that will accommodate variable degrees of flexion depending on golfer specific conditions (e.g. height, arm and leg length, weight, etc.) and environmental conditions (course conditions, ball lie, playing hazards, etc.). The adjustable hinge assembly operates in both a locked position mode that prevents the knee from flexing and an unlocked position mode that permits unrestricted ambulation. The method for controlling and stabilizing the swing mechanics of a golfer comprises selecting an optimum knee flexion angle, locking the knee at the selected angle, approaching the ball in preparation for a golf swing, and swinging the club through all phases of the golf swing (e.g. take-away, impact, and follow-through). The method further comprises unlocking the knee to permit unrestricted ambulation for walking to the next swing position then selecting an additional knee flexion angle (that may be the same or different as the first depending on golfer and environmental conditions) and locking the knee at the selected angle.

DRAWINGS

Other objects and advantages of the present invention will become apparent from the following detailed description of the invention, taken in conjunction with the accompanying drawings, wherein.

Figure 8A:
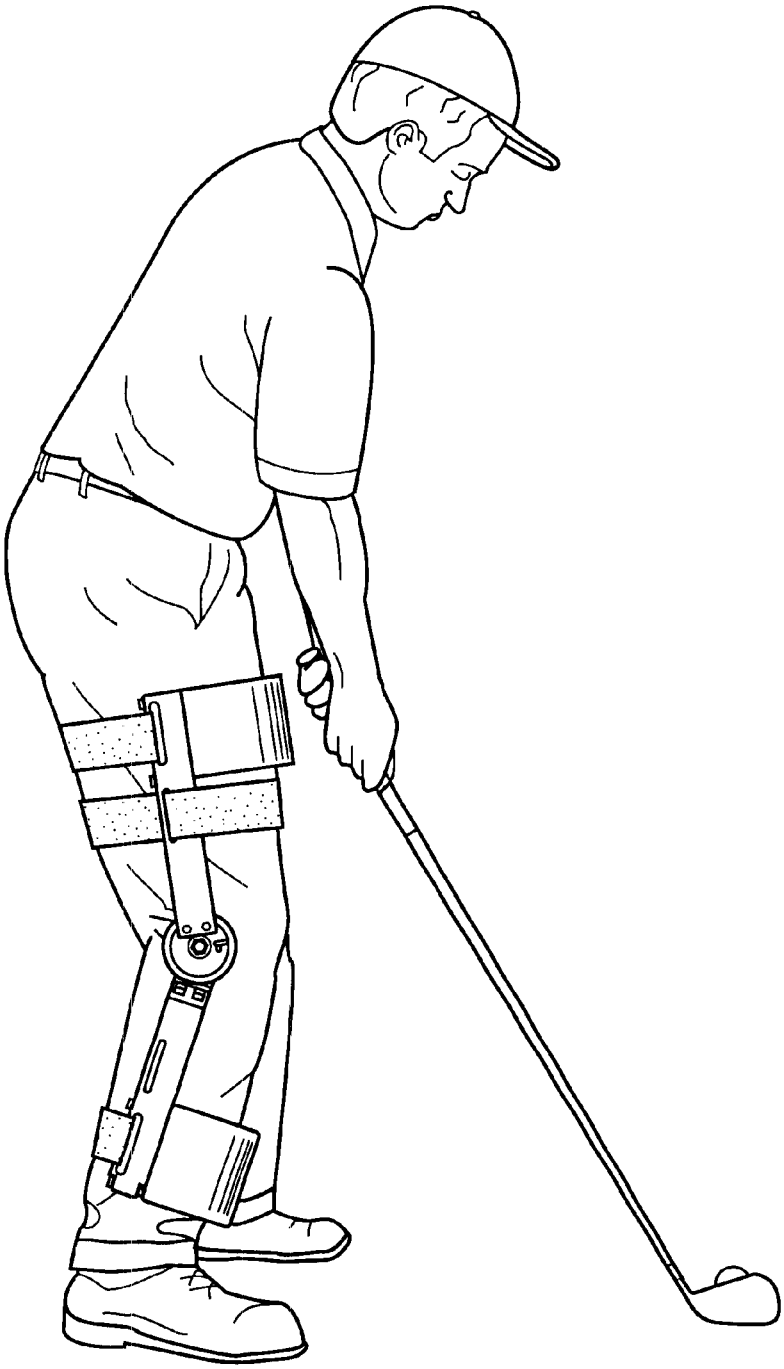
Figure 8B:
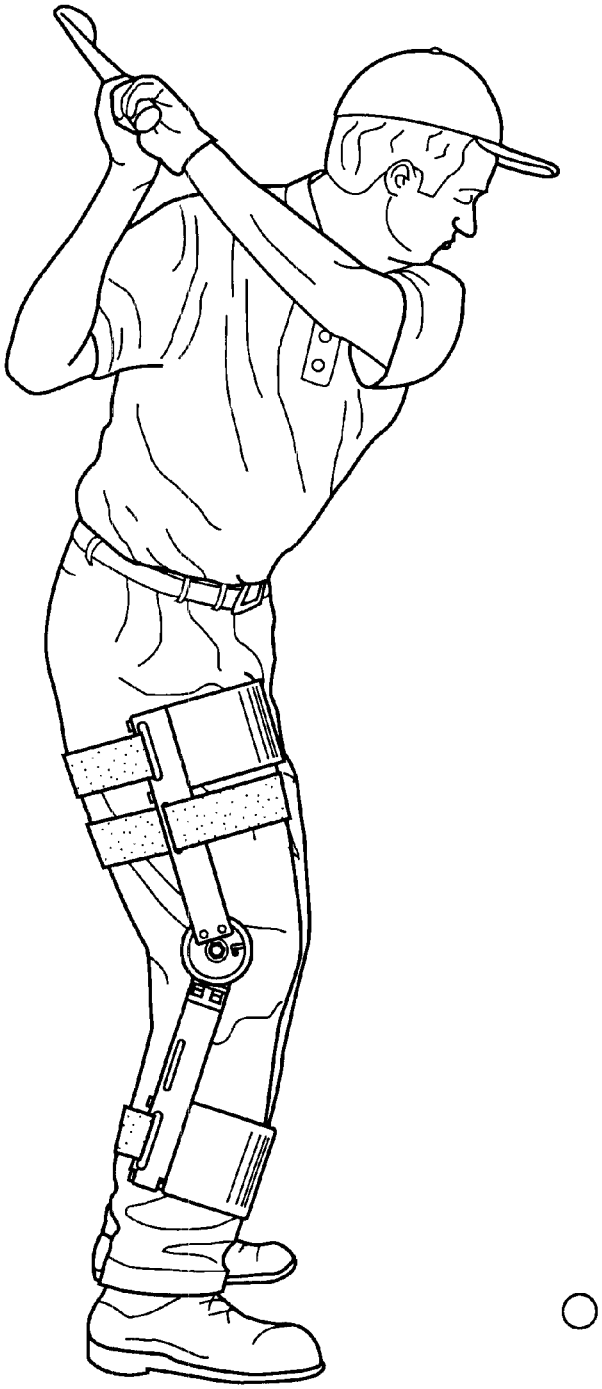
Figure 8C:
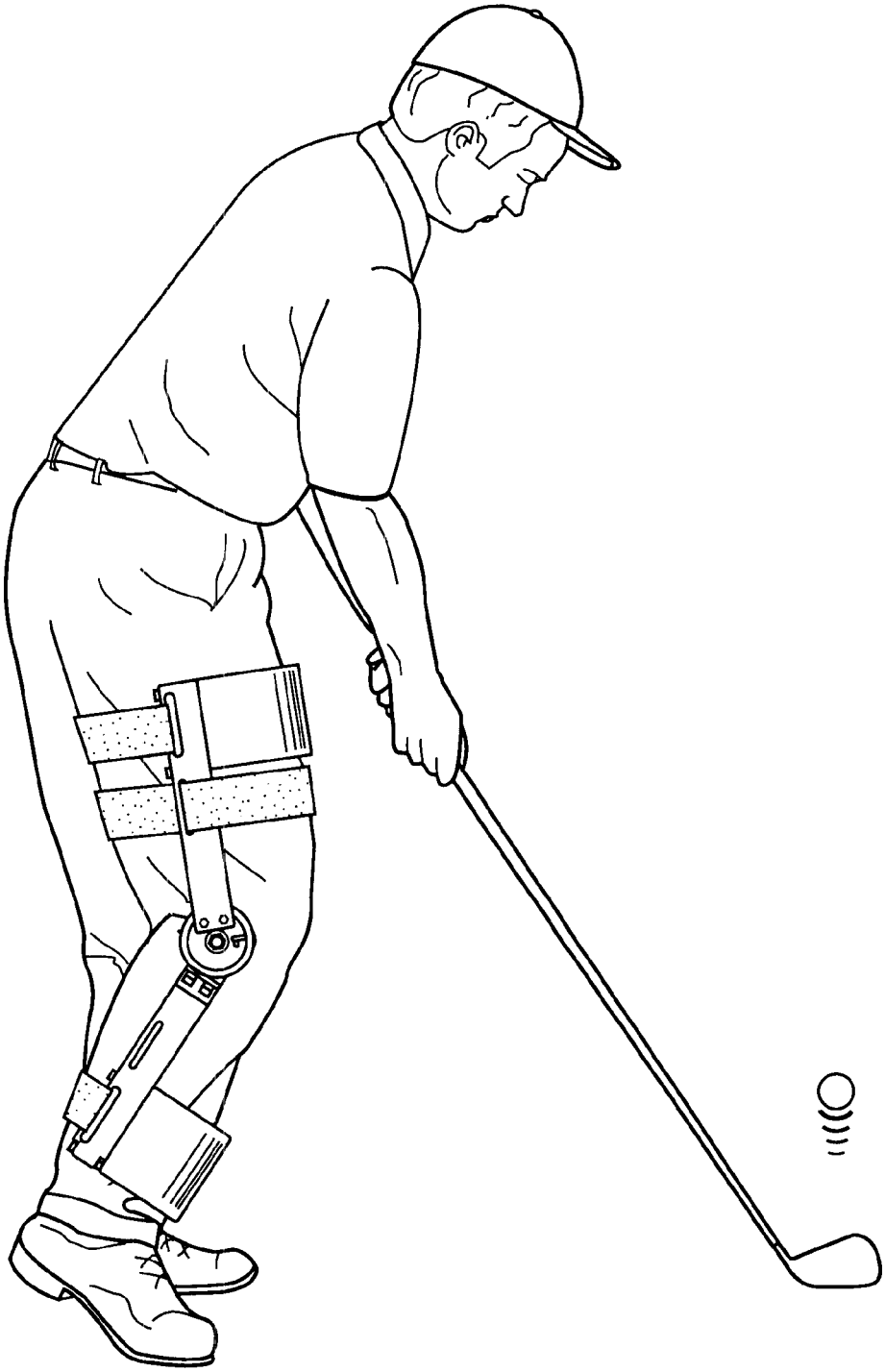

FIGS. 8A, 8B, and 8C depict a lateral view of a golf swing sequence demonstrating the apparatus and method for controlling and stabilizing the swing mechanics of a golfer in accordance with the present invention.

Figure 9A:
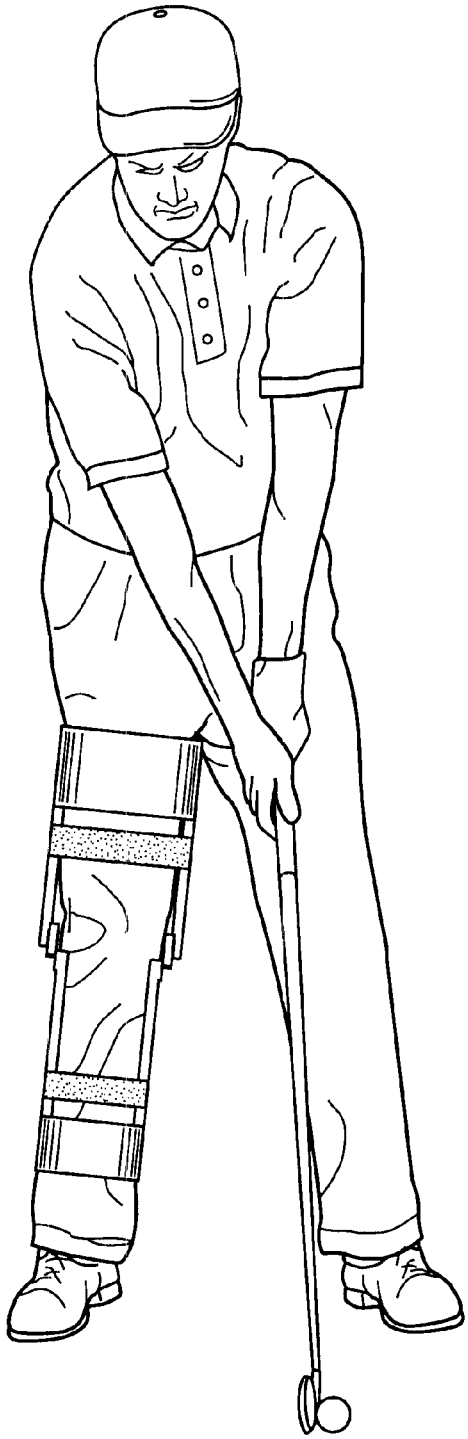
Figure 9B:
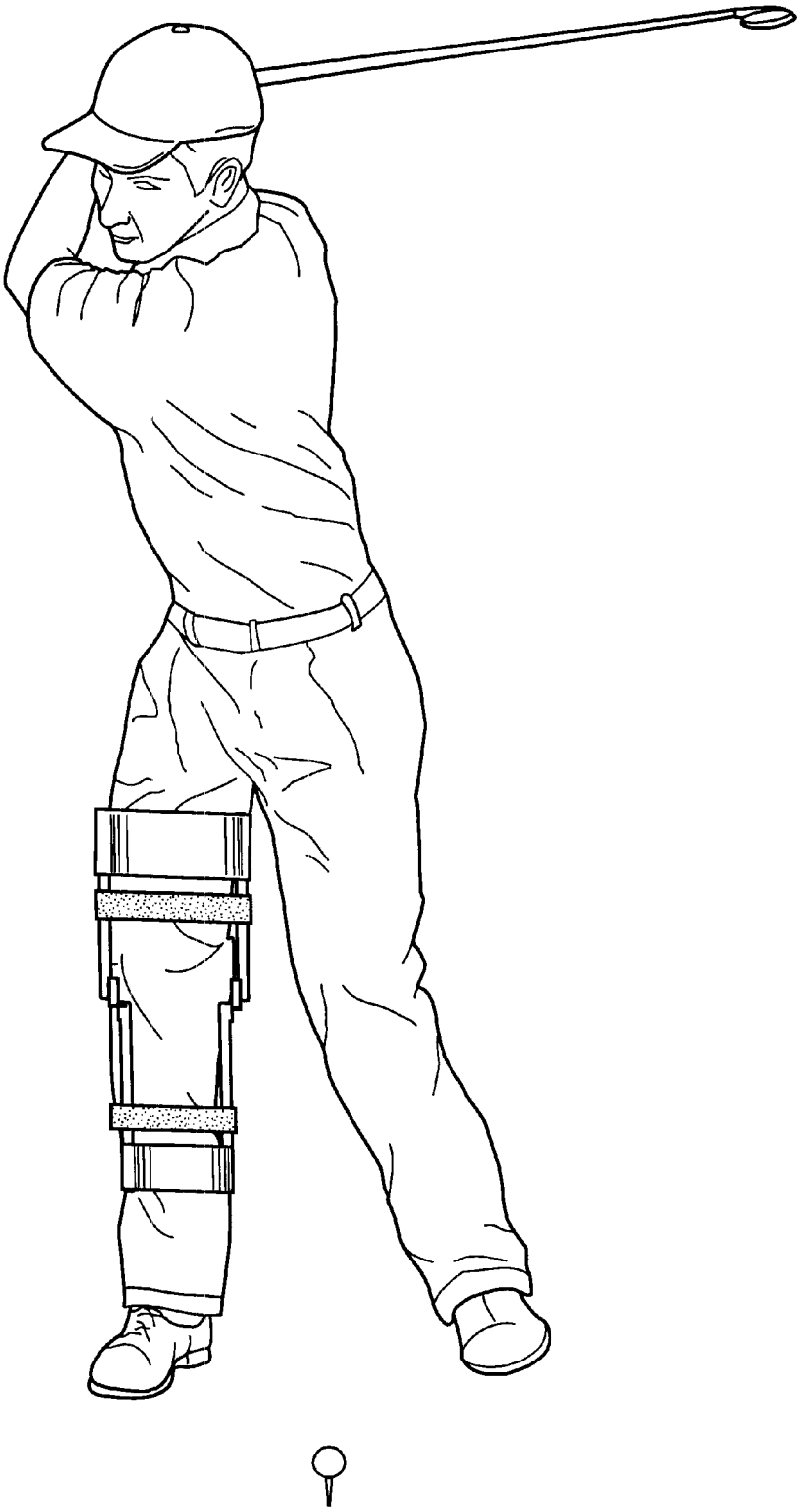
Figure 9C:
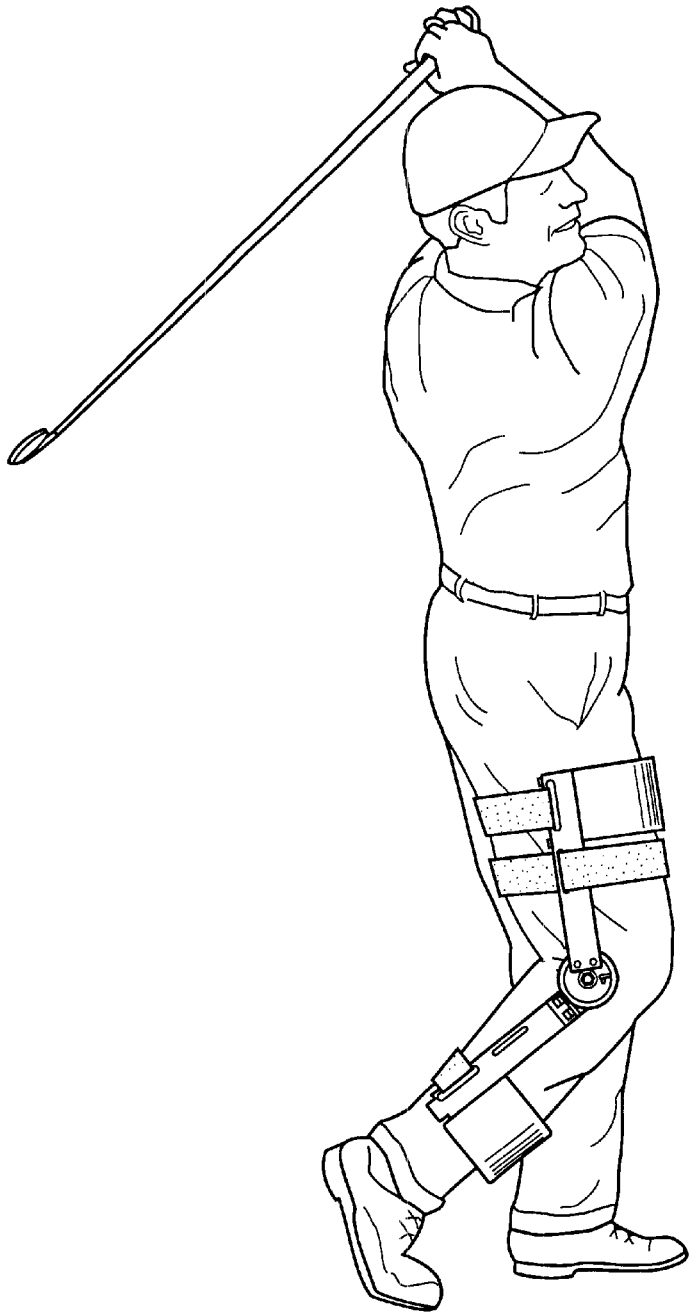

FIGS. 9A, 9B, and 9C depict a frontal view of golf swing sequence demonstrating the apparatus and method for controlling and stabilizing the swing mechanics of a golfer in accordance with the present invention.

DETAILED DESCRIPTION

Figure 2:
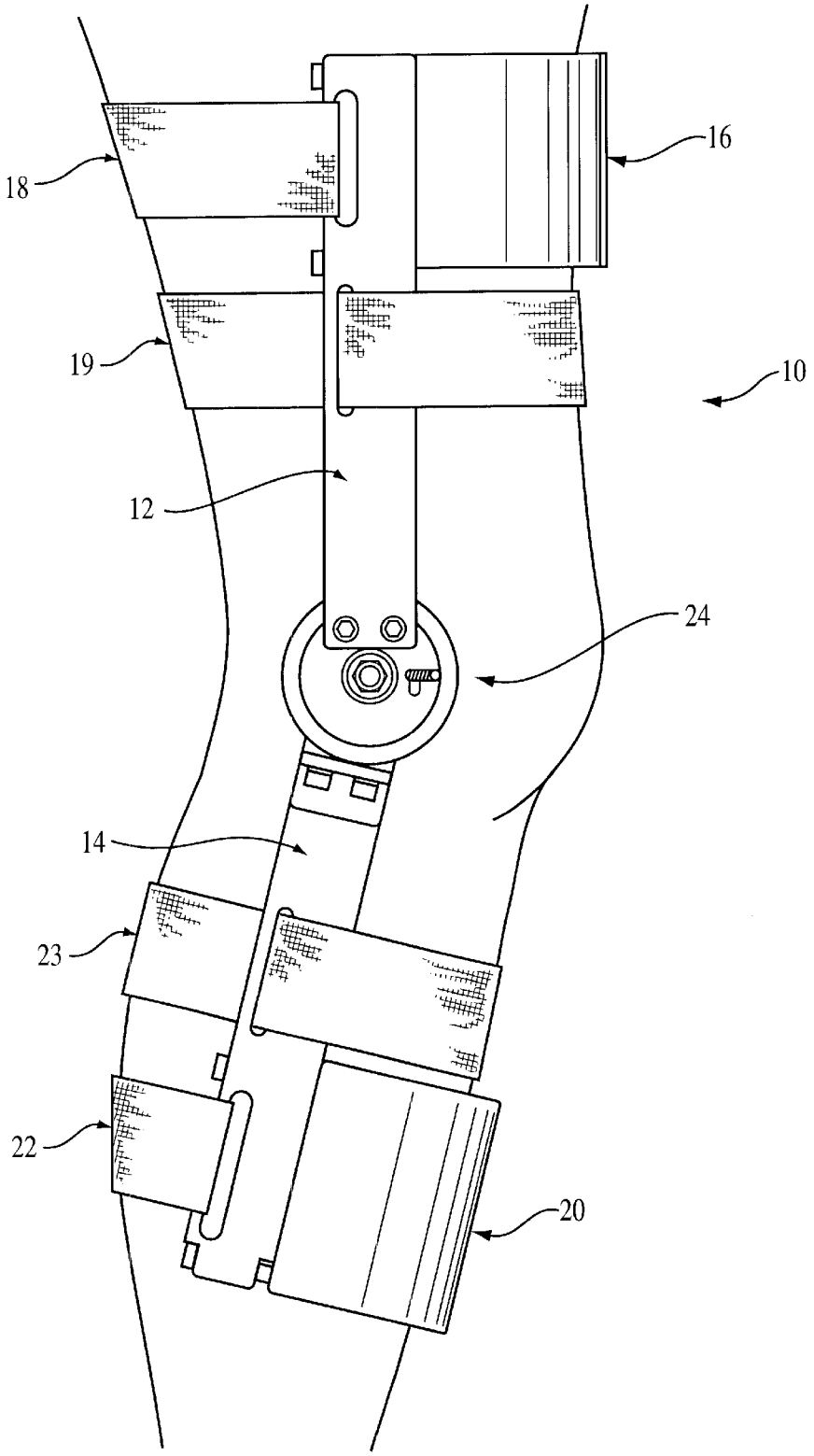
FIG. 2 depicts the apparatus for controlling and stabilizing the swing mechanics of a golfer in accordance with the present invention as worn on the right leg of a golfer.

The novel apparatus and method for controlling and stabilizing the swing mechanics of a golfer of the subject invention is now described with reference to FIGS. 2 through 9. Referring to FIG. 2, there is shown an apparatus 10 for controlling and stabilizing the swing mechanics of a golfer in accordance with the present invention as worn on the right leg of a golfer. Only one side of the apparatus is shown in the figure. In the preferred embodiment, the other side contains the same parts and configuration of the side that is shown. It is to be also understood that while the embodiment shown in the figures and described herein is with reference to a right leg of a golfer, i.e. a right handed golfer, the present invention is equally applicable to the left leg of a golfer, i.e. a left handed golfer.

The apparatus 10 includes upper struts 12, lower struts 14, an upper anterior femur/thigh support member 16, an upper posterior femur/thigh support member 18, a lower anterior leg support member 20, a lower posterior leg support member 22, and hinge assemblies 24. The apparatus 10 is generally configured to form a relatively rigid structure about the right knee of the golfer. In this regard, the apparatus 10 stabilizes the right knee and allows the right knee to maintain its critical knee flexion angle throughout the swing.

Figure 3A:
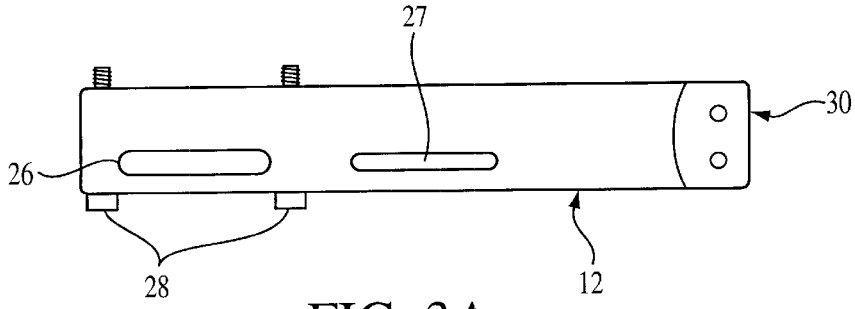
FIGS. 3A and 3B are frontal and side views, respectively, of the upper strut of the apparatus for controlling and stabilizing the swing mechanics of a golfer in accordance with the present invention.
Figure 3B:
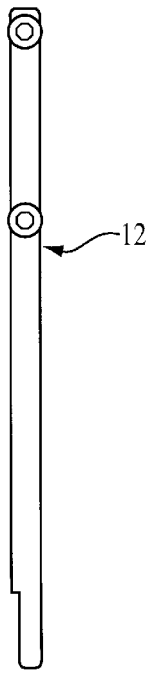

As shown in FIGS. 3A and 3B, the upper strut 12 generally comprises a rigid elongated member having fastening structures at either end. The upper strut 12 is preferably formed from a rigid, light weight material such as aluminum or plastics. An opening 26 is formed in one end of the strut 12 to receive a portion of the upper posterior femur/thigh support member 18. The strut 12 can include additional openings, such as opening 27, in order to receive a second upper posterior femur/thigh support member 19. A pair of locking bolts 28 are shown which are configured to operably attached the upper strut 12 to the upper anterior femur/thigh support member 16. At the other end of the upper strut 12 there is a cutout 30 to allow for bolting of the strut to the hinge assembly as shown in FIG. 2.

Figure 4A:
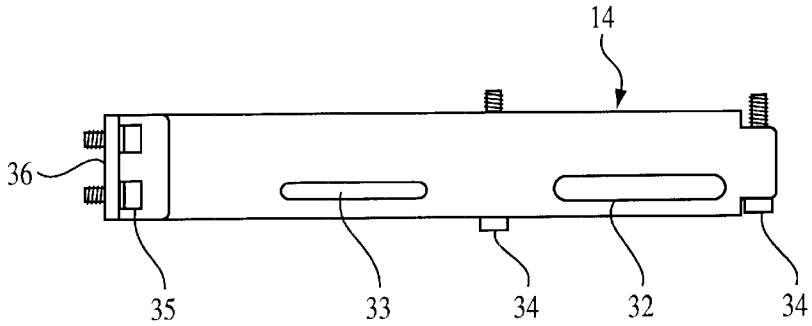
FIGS. 4A and 4B are frontal and side views, respectively, of the lower strut of the apparatus for controlling and stabilizing the swing mechanics of a golfer in accordance with the present invention.
Figure 4B:
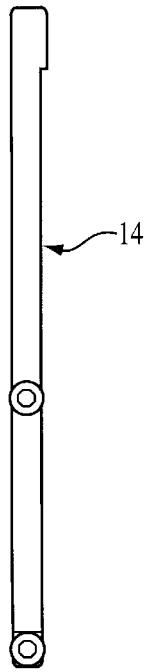

Similarly, as shown in FIGS. 4A and 4B, the lower strut 14 generally comprises a rigid elongated member having fastening structures at either end. Like the upper strut 12, the lower strut 14 is preferably formed from a rigid, light weight material such as aluminum or plastics. An opening 32 is formed in one end of the strut 14 to receive a portion of the lower posterior leg support member 22. The strut 14 can include additional openings, such as opening 33, in order to receive another lower posterior leg support member 23. A pair of locking bolts 34 are shown which are configured to operably attached the lower strut 14 to the lower anterior leg support member 20. At the other end of the lower strut 14 there is a flange 36 with bolts 35 to allow for bolting of the strut to the hinge assembly 24 as shown in FIG. 2.

Figure 5A:
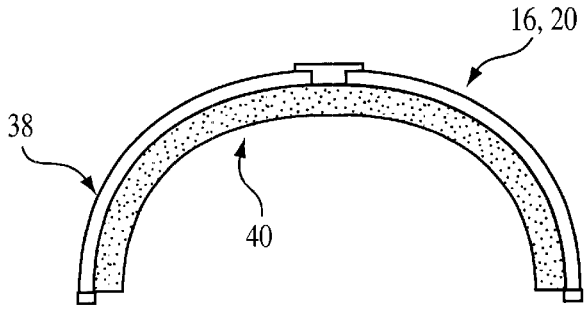
FIGS. 5A and 5B are frontal and isometric views, respectively, of the femur/thigh support or the lower leg support of the apparatus for controlling and stabilizing the swing mechanics of a golfer in accordance with the present invention.
Figure 5B:
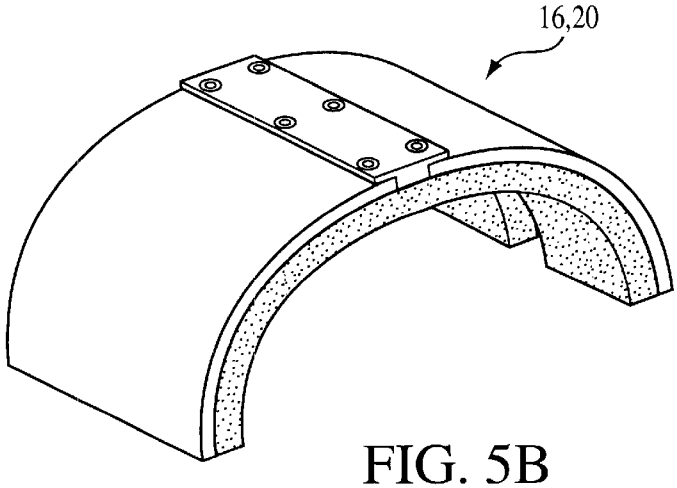

Referring to FIGS. 5A and 5B, there is shown frontal and isometric views, respectively, of the upper anterior femur/thigh support structure 16 and the lower anterior leg support structure 20. These structure are generally configured in the same shape as shown, although their respective dimensions may differ to accommodate the differing structures of the thigh and calf area. The support structures 16, 20 comprise an outer body 38 preferably formed from a rigid, light weight material such as aluminum or plastics. The support structures 16, 20 also include an inner fabric or cushion lining (such as, for example, felt) to increase comfort and wearability of the apparatus 10.

The upper posterior femur/thigh support member 18 and the lower posterior leg support member 22 (as well as the optional members 19 and 23) are preferably straps formed from a fabric material that can wrap around the golfers leg and pass through the respective openings 26, 32 of the upper 12 and lower 14 struts. The support members 18, 22 also preferably include a hook and loop fastener, such as VELCRO brand, such that the strap members 18, 22 can wrap around the golfers leg and pass through the respective openings 26, 32 of the upper 12 and lower 14 struts and be secured upon itself in a manner known in the art. Preferably, additional strut openings 27, 33 are formed in the struts 12, 14 to accept additional straps 19 and 23 as shown in FIG. 2.

In an alternative embodiment, the upper anterior femur/thigh support member 16 and the upper posterior femur/thigh support member 18 comprise a single member formed of a rigid material, such as aluminum or plastic, that is secured to the upper strut 12. Similarly, the lower anterior leg support member 20 and lower posterior leg support member 22 may comprise a single member formed of a rigid material, such as aluminum or plastic, that is secured to the lower strut 14. These singular members would include buckle type fasteners to lock the respective support members to the thigh and calf area of a golfer's leg.

Figure 6:
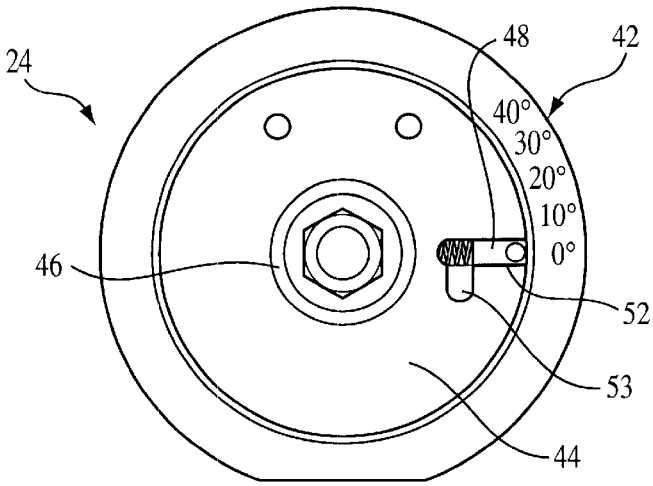
FIG. 6 is a frontal view of the hinge assembly of the apparatus for controlling and stabilizing the swing mechanics of a golfer in accordance with the present invention.

Referring now to FIG. 6, there is shown the hinge assembly 24 of the apparatus for controlling and stabilizing the swing mechanics of a golfer in accordance with the present invention. In the preferred embodiment, there are two hinge assemblies 24 in the apparatus 10; one hinge assembly on each side of the apparatus 10. In an alternative embodiment, the apparatus is configured to have only one hinge assembly 24. The hinge assembly is configured to allow for and permit the golfer to easily adjust for different right knee flexion angles. That is, depending on the golfers individual set up or particular type of shot being played, different flexion angles will be provided through the hinge assemblies 24. Each hinge assembly 24 is positioned on either side of the golfer's knee as shown in FIG. 2 such that, with the struts 12, 14 and upper and lower supports 16, 18, 20, 22, a rigid structure is provided that locks the knee at the appropriate flexion angle. At the same time, the unique configuration allows the golfer to adjust the locked position of the hinge assembly so that the knee flexion angle can be modified depending on the type of shot, the type of course or weather conditions, or the particular set up characteristics of the golfer.

Figure 7A:
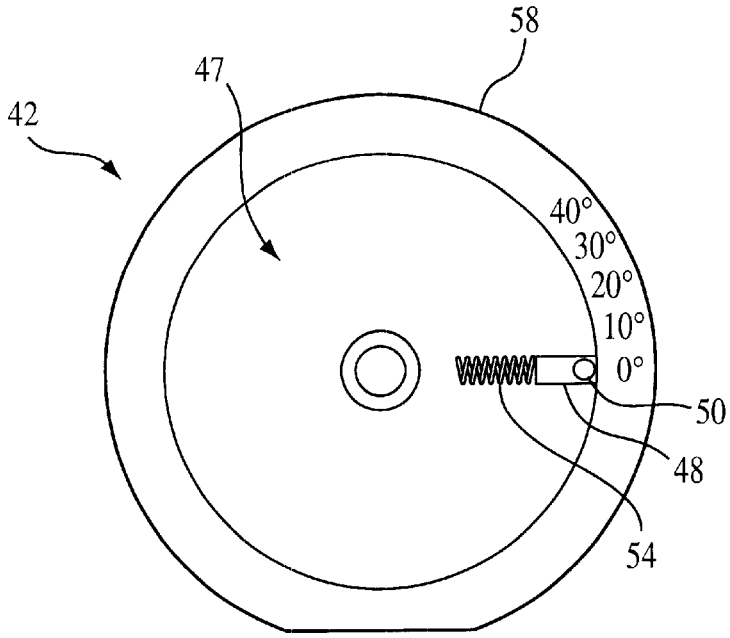
FIG. 7A is a frontal view of the outer disc assembly of the hinge assembly of the apparatus for controlling and stabilizing the swing mechanics of a golfer in accordance with the present invention.
Figure 7B:
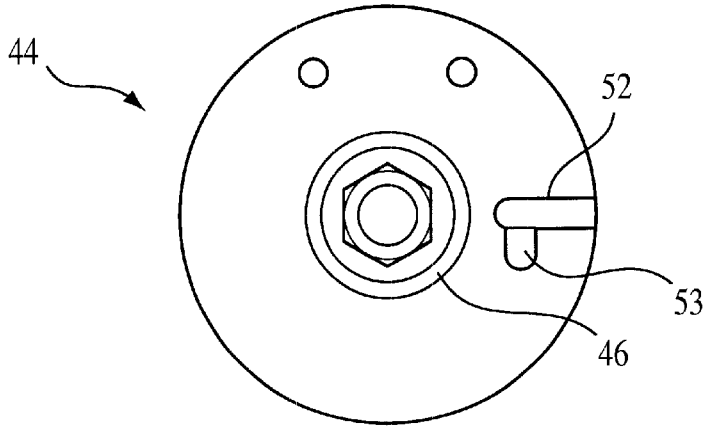
FIG. 7B is a frontal view of the inner disc assembly of the hinge assembly of the apparatus for controlling and stabilizing the swing mechanics of a golfer in accordance with the present invention.
Figure 7C:
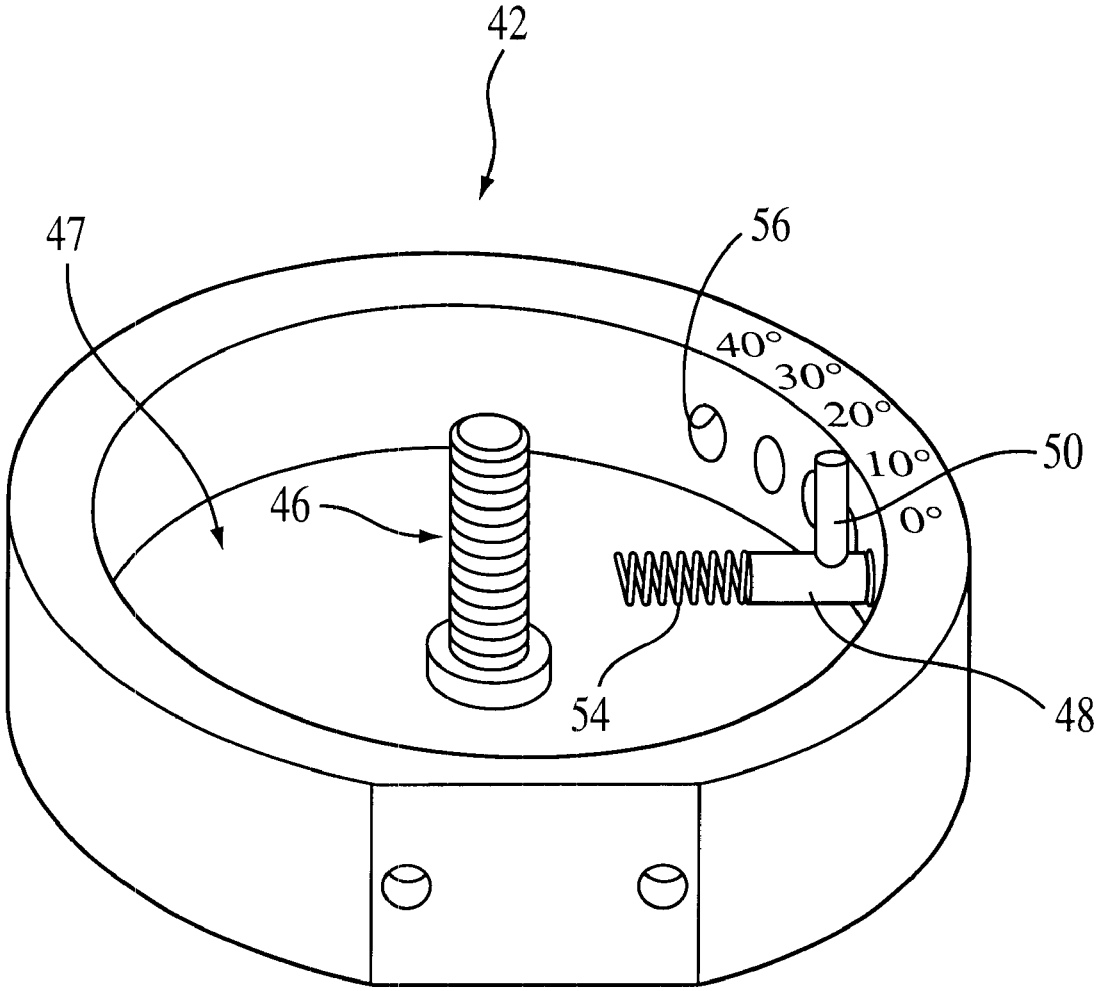
FIG. 7C is an isometric view of the hinge assembly of the apparatus for controlling and stabilizing the swing mechanics of a golfer in accordance with the present invention.

Referring to FIGS. 6 and 7A–7C, the hinge assembly 24 comprises an outer disc 42 and an inner disc 44 that are operably and rotatably attached by a center bolt 46. Preferably, the center of rotation of the hinges align with the central rotational axis of the knee as shown. The inner disc 44 is received within a circular cutout formed in the outer disc 42 as shown in FIG. 6. This cutout provides for a bearing surface 47 upon which the inner disc 44 can easily and smoothly be rotated to set varying flexion angles. The hinge assembly includes a locking pin 48 with lever 50 that slides within a cutout 52 of the inner disc 44. A compression spring 54 is secured to the center bolt 46 and is biased so as to provide a radially outward force against the locking pin 48. The outer disc 42 includes receiving holes 56 that accept an end of the locking pin 48 which is biased into the holes by the spring 54. The receiving holes are formed around an inner parameter of the outer disc 42 as shown in FIG. 7C. The receiving holes are formed at specified angles from the vertical axis, such as, for example, every 10 degrees off the vertical as shown. Corresponding flexion angle identification markings are formed about the parameter of the outer disc 42 and are preferably formed so as to easily and conveniently be seen by a golfer when the apparatus 10 is worn.

As shown in FIG. 2, the outer disc 42 is operably connected to the lower strut 14 such that the lower strut 14 lies along the vertical axis at the zero degree marking. Similarly, inner disc 44 is operably connected to the upper strut 12 such that the upper strut 12 lies along the vertical axis at the zero degree marking.

In use, the golfer can easily and reliably adjust the knee flexion angle of the hinges 24 of the apparatus 10 be simply pushing down on the lever 50 to remove the locking pin from the receiving holes 56 formed in the outer disc 42. The golfer then rotates the outer disc 42 with respect to the inner disc 44 about the bolt or pin 46 to the desired knee flexion angle as indicated by the markings formed on the surface of the outer disc 42. The compression spring 54 will then force the pin 46 into the corresponding hole formed in the outer disc 42 to lock the hinge at the selected flexion angle.

If a golfer desires to maintain the hinge assemble in an unlocked position in order to permit unrestricted ambulation, then the golfer slides the pin 46 into the cutout 53 such that the pin 46 will be prevented from sliding into a receiving hole 56. This will permit the golfer to walk freely to another swing position at which time the golfer can select a new flexion angle. This novel configuration enables the golfer to rapidly, reliably, and easily adjust the knee flexion angle when necessary to accommodate different playing conditions or swing types. For example, when a golfer is at the tee preparing to hit a drive, the knee flexion angle is preferably set at 30 degrees. However, when the golfer is hitting a chip shot, the golfer can walk freely to a new position and another knee flexion angle that is more appropriate may be selected. The inventive method and apparatus disclosed and claimed may also be effectively employed in training sessions on a golf driving range whereby a golfer can practice a variety of different swing sequences. More particularly, a golfer can practice the swing at one flexion angle (e.g. at an angle effective for drives) and easily change the flexion angle setting to practice the swing at another flexion angle (e.g. at an angle effective for chip shots).

The particular flexion angle selected by the golfer will depend on a variety of factors including a golfer's physical makeup. For example, the flexion angle will depend on a golfer's height, body-to-leg ratio, and arm length. Generally, sand or flop shots will require greater knee flexion angles because a golfer will take a more shallow approach to the ball. However, the flexion angle for a drive or teed-up shot will generally require a lesser knee flexion angle.

Figure 1A:
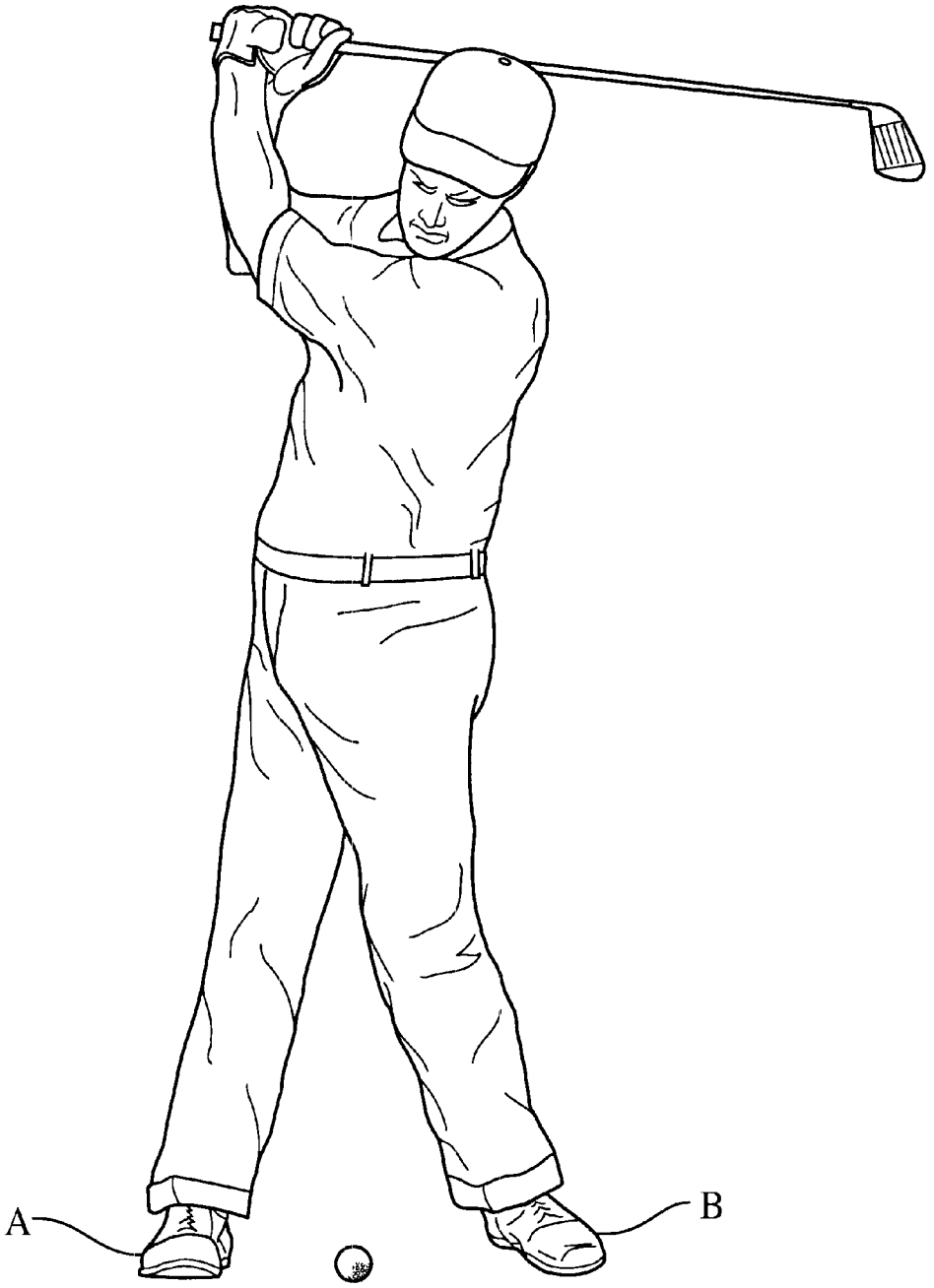
FIGS. 1A and 1B depict a frontal view of a golf swing sequence demonstrating the common swing fault referred to as reverse pivot.
Figure 1B:
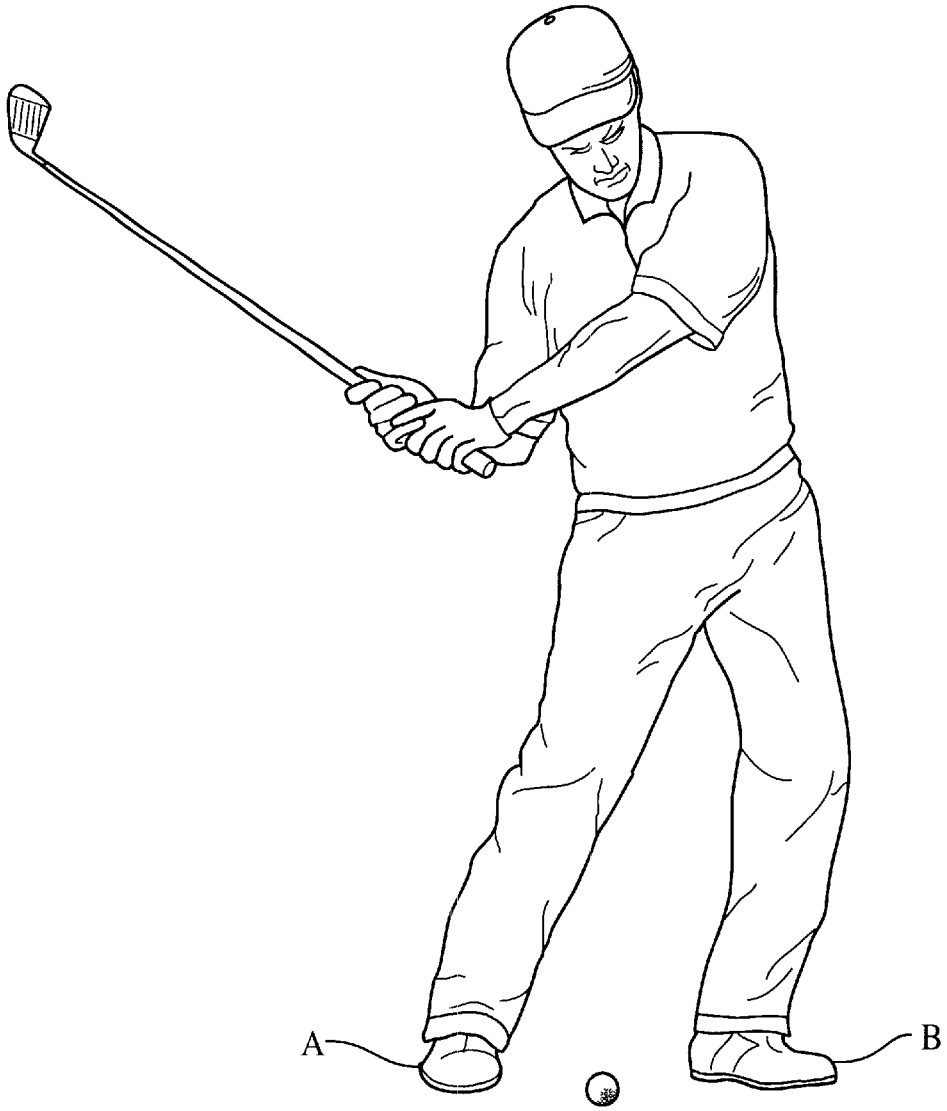

Referring now to FIGS. 8A to 8C (lateral view) and FIGS. 9A to 9C (frontal view), there is shown a view of a golf swing sequence demonstrating the apparatus and method for controlling and stabilizing the swing mechanics of a golfer in accordance with the present invention. More particularly, there is shown a swing sequence of a right handed golfer with a right knee stabilizer of the present invention in place. Note in comparison to FIGS. 1A and 1B, the golfer's right knee flexion angle present at the ball address position (FIGS. 8A and 9A) is maintained throughout the entire swing sequence (FIGS. 8A–8C and 9A–9C). This permits the golfers weight to be transferred and allows for proper loading of the right side. It is well known that a proper backswing tremendously increases your chances for a successful downswing, and with a proper loaded right side at the top the swing the knee stabilizer of the present invention will allow for a proper downswing sequence. Thus, the golfer's swing is controlled and stabilized allowing for a much improved golf game.

Furthermore, other swing faults are addressed and resolved with the apparatus and method of the instant invention. Specifically, right knee lateral sway is minimized because the apparatus and method of the present invention will not allow the knee to breakdown and cause a lateral sway. Also, vertical motion is prevented because the apparatus and method of the present invention will keep the right knee secured at a constant angle thus precluding any "up and down" motion. Moreover, the excessive lower body motion associated with the short game is minimized because the apparatus and method of the present invention will provide a solid base for both chipping and putting and prevent the subtle movements that can destroy an effective short game. In addition, the apparatus and method of the present invention will produce a shorten and compact golf swing. Specifically, by stabilizing the right knee in the manner of the invention, an extra long swing will be prevented because the truncal/lower extremity musculature of the golfer will be maximally stretched much earlier than if the golfer were to sway or extend the right leg. The inventive knee stabilizer also provides a positive kinesthetic sense of lower body support.

The inventive method and apparatus has been shown to significantly improve the golf mechanics and improved ball striking ability of golfers. A study was conducted using the method and apparatus of the invention whereby a total of ten golfers—nine right-handed and one left-handed golfers—(9 male, 1 female) were analyzed with two plane video analysis for the purposes of evaluating the benefits of a right knee (left knee for left hand golfers) stabilizer in the golf swing. All players used a 5-Iron. Right knee flexion angles were recorded utilizing interactive systems computer software at the address, transition, and impact positions. Players were analyzed before (data set A below), during (data set B below), and after (data set C below) wearing a right knee stabilizer apparatus of the invention during a single trial. At all stages of the trial each golfer made several swings prior to data collection. Subjective ball striking was recorded as a thin, heavy, or sold shot.

The results of the study demonstrate that significant improvements can be achieved with the instant invention. The results of the study are shown in Table 1 below.

TABLE 1

Knee Stabilizer Data
All numbers are in degrees unless otherwise stated

| Player | ball contact Pre-Knee stabilizer | | | Ball contact Knees Stabilizer applied | | | ball contact Post-Knee Stabilizer | | |
|---|---|---|---|---|---|---|---|---|---|
| (hcp.) | address | transition | impact | address | transition | impact | address | transition | impact |
| 1(12) | 34 | 23 | 26 solid | 35 | 33 | 34 solid | 32 | 31 | 30 heavy |
| 2(22) | 20 | 11 | 10 thin | 25 | 23 | 24 solid | 22 | 19 | 23 solid |
| 3(27) | 38 | 48 | 30 thin | 35 | 36 | 33 solid | 36 | 40 | 30 heavy |
| 4(3) | 28 | 23 | 22 heavy | 30 | 29 | 27 thin | 26 | 24 | 27 solid |
| 5(11) | 35 | 18 | 24 solid | 35 | 31 | 31 thin | 38 | 34 | 32 solid |
| 6(19) | 18 | 27 | 24 solid | 20 | 24 | 24 heavy | 15 | 15 | 16 solid |
| 7(8) | 27 | 28 | 29 solid | 30 | 31 | 29 solid | 30 | 33 | 30 solid |
| 8(16) | 32 | 21 | 23 thin | 30 | 25 | 26 solid | 28 | 21 | 21 thin |
| 9(11) | 17 | 11 | 19 thin | 25 | 22 | 20 solid | 20 | 16 | 16 heavy |
| 10(31) | 40 | 33 | 30 solid | 35 | 31 | 34 thin | 36 | 38 | 34 solid |
| Average | 26.8 | 24.3 | 23.8 | 30 | 25.6 | 26.2 | 28 | 27.1 | 25.9 |
| SD | 7.882401 | 9.859813 | 6.679028 | 5 | 4.4777226 | 4.5583143 | 7.28011 | 8.746868 | 6.187691 |

| Player | A: Total Degree Change | B: Total Degree Change | C: Total Degree Change |
|---|---|---|---|
| 1 | 13 | 3 | 2 |
| 2 | 10 | 3 | 7 |
| 3 | 24 | 4 | 14 |
| 4 | 7 | 4 | 4 |
| 5 | 21 | 4 | 5 |
| 6 | 12 | 4 | 1 |
| 7 | 2 | 3 | 8 |

TABLE 1-continued

| Knee Stabilizer Data<br>All numbers are in degrees unless otherwise stated | | | |
|---|---|---|---|
| 8 | 13 | 8 | 5 |
| 9 | 14 | 3 | 4 |
| 10 | 10 | 7 | 6 |
| Average | 12.6 | 4.1 | 5.5 |

T-Test
P-Values
Two tailed
A vs B 0.002304
A vs C 0.002895
B vs C 0.260592

The average total degree change of the right knee flexion angle in data set A was 12.6; the average total degree change of the right knee flexion angle in data set B was 4.1; and the average total degree change of the right knee flexion angle in data set C was 5.5. The data was analyzed utilizing paired students T-test. Statistical significance was set at $p<0.05$. There was a highly significant difference ($p<0.002$) in knee flexion change when comparing golf swings before and while wearing the knee stabilizer apparatus. Additionally, the total knee flexion angle change before and after wearing the knee stabilizer apparatus was highly significant ($p<0.002$). Finally, there was no statistical difference in knee flexion angle while wearing the knee stabilizer apparatus and after wearing the knee stabilizer apparatus. Subjectively, 80% of the players felt that the apparatus of the instant invention definitely improved their ball striking. The study has shown that maintaining a relative constant right knee flexion angle during the golf swing can be been achieved with the novel apparatus and method of the invention and a significant improvement in ball striking ability of most players.

With the novel apparatus and method for controlling and stabilizing the swing mechanics of a golfer, the majority of the swing faults that have heretofore plagued the recreational golfer are addressed and resolved. The apparatus and method of the present invention stabilizes the right knee (the left knee for left handed golfers) of a golfer such that a critical knee flexion angle is maintained throughout the golf swing, the weight of the golfer is properly transferred, and the right hand side (left hand side for left handed golfers) is properly loaded. This ensures that the golfer's swing is reliable, consistent, controlled, and safe.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. An apparatus for controlling and stabilizing the swing of a golfer comprising:

an upper support member for engaging a portion of a golfer's leg above the golfer's knee;

a lower support member for engaging a portion of a golfer's leg below the golfer's knee;

a first hinge assembly;

a second hinge assembly;

a first upper strut operably connected to said upper support member at one position along its length and operably connected to the first hinge assembly at another position along its length;

a second upper strut operably connected to said upper support member at one position along its length and operably connected to the second hinge assembly at another position along its length;

a first lower strut operably connected to said lower support member at one position along its length and operably connected to the first hinge assembly at another position along its length;

a second lower strut operably connected to said lower support member at one position along its length and operably connected to the second hinge assembly at another position along its length;

said first and second hinge assemblies further comprise a first hinge structure having an inner bearing surface and a second hinge structure configured to be received within the inner bearing surface of the first hinge structure, said first and second hinge structures configured to rotate with respect to one another;

wherein said first and second hinge assemblies are configured to position and lock the upper support member at an angle with respect to the lower support member;

at least one of the first and second hinge assemblies including flexion angle markings that indicate the angular position at which the upper support member is positioned and locked with respect to said lower support member;

a locking pin operably engageable with said first hinge structure and said second hinge structure, said locking pin operable between a first position and a second position such that when said locking pin is in said first position, said first and second hinge structures are free to rotate with respect to each other and when said locking pin is in said second position, said first and second hinge structures are not free to rotate with respect to each other; and wherein said second hinge structure is provided with a slot operable to receive said locking pin and said apparatus further comprising a spring that is secured at one end to said locking pin and at the other end to a pin positioned at a respective center of the first and second hinge structures.

2. An apparatus for controlling and stabilizing the swing of a golfer as defined in claim 1 wherein said slot is configured such that said locking pin slides within the slot against the force of said spring as said locking pin is moved from said second position to said first position and said slot being further configured to maintain said locking pin in said first position.

3. An apparatus for controlling and stabilizing the swing of a golfer as defined in claim 1 wherein said upper support member includes an angular member having a shape in cross-section approximating a semi-circle and configured to engage the anterior thigh of a golfer and said lower support member comprises an angular member having a shape in cross-section approximating a semi-circle and configured to engage the anterior lower leg of a golfer.

4. An apparatus for controlling and stabilizing the swing of a golfer as defined in claim 3 wherein said upper support member further includes at least one strap, said strap operable to engage said first and second upper struts through respective openings formed in said first and second upper struts and said lower support member further includes at least one strap, said strap operable to engage said first and second lower struts through respective openings formed in said first and second lower struts.

5. An apparatus for controlling and stabilizing the swing of a golfer as defined in claim 4 where in said straps are formed from a fabric material and include a hook and loop type fastener.

6. An apparatus for controlling and stabilizing the swing of a golfer as defined in claim 1 wherein said locking pin is configured to be received within holes formed in said first hinge structure when said locking pin is in said second position.

7. An apparatus for controlling and stabilizing the swing of a golfer as defined in claim 1 wherein said upper and lower support members are formed of a rigid and light weight material.

8. An apparatus for controlling and stabilizing the swing of a golfer comprising:

an upper support member for engaging a portion of a golfer's leg above the golfer's knee;

a lower support member for engaging a portion of a golfer's leg below the golfer's knee;

a first hinge assembly;

a second hinge assembly;

a first upper strut operably connected to said upper support member at one position along its length and operably connected to the first hinge assembly at another position along its length;

a second upper strut operably connected to said upper support member at one position along its length and operably connected to the second hinge assembly at another position along its length;

a first lower strut operably connected to said lower support member at one position along its length and operably connected to the first hinge assembly at another position along its length;

a second lower strut operably connected to said lower support member at one position along its length and operably connected to the second hinge assembly at another position along its length;

said first and second hinge assemblies further comprise a first hinge structure having an inner bearing surface and a second hinge structure configured to be received within the inner bearing surface of the first hinge structure, said first and second hinge structures configured to rotate with respect to one another;

wherein said first and second hinge assemblies are configured to position and lock the upper support member at an angle with respect to the lower support member;

at least one of the first and second hinge assemblies including flexion angle markings that indicate the angular position at which the upper support member is positioned and locked with respect to said lower support member; and an upper strap that is configured to wrap around a golfer's leg and pass through at least an opening in one of said first and second upper struts for securing the upper support member on a golfer's leg.

9. An apparatus for controlling and stabilizing the swing of a golfer as defined in claim 8 wherein said flexion angle markings include an identification of the angle at which the upper support member is positioned and locked with respect to said lower support member.

10. An apparatus for controlling and stabilizing the swing of a golfer as defined in claim 9 wherein said identified flexion angle markings includes a 30 degree marking.

11. An apparatus for controlling and stabilizing the swing of a golfer as defined in claim 9 wherein said identified flexion angle markings include a 0 degree, 10 degree, 20 degree, 30 degree, and 40 degree marking.

12. An apparatus for controlling and stabilizing the swing of a golfer as defined in claim 8 wherein said upper strap includes a hook and loop fastener for securing the strap.

13. An apparatus for controlling and stabilizing the swing of a golfer as defined in claim 8 further comprising an additional upper strap that is configured to wrap around a golfer's leg and pass through at least one opening in one of said first and second upper struts.

14. An apparatus for controlling and stabilizing the swing of a golfer as defined in claim 8 further comprising a lower strap that is configured to wrap around a golfer's leg and pass through at least an opening in one of said first and second lower struts for securing the lower support member on a golfer's leg.

15. An apparatus for controlling and stabilizing the swing of a golfer as defined in claim 14 wherein said lower strap includes a hook and loop fastener for securing the strap.

16. An apparatus for controlling and stabilizing the swing of a golfer as defined in claim 14 further comprising an additional lower strap that is configured to wrap around a golfer's leg and pass through at least one opening in one of said first and second lower struts.

17. A method of controlling and stabilizing the swing of a golfer comprising the steps of:

(a) placing an apparatus on one leg of the golfer, said apparatus including an upper support member for engaging a portion of a golfer's leg above the golfer's knee; a lower support member for engaging a portion of a golfer's leg below the golfer's knee; and at least one hinge assembly operably connected to said upper support member and said lower support member, said hinge assembly configured to position and lock the upper support member at an angle with respect to the lower support member;

(b) selecting an optimum knee flexion angle based on the characteristics of a golfer;

(b) locking a knee of the golfer at the selected flexion angle;

(c) approaching the ball in preparation for a golf swing; and (d) swinging the club through all phases of the golf swing.

18. The method for controlling and stabilizing the swing mechanics of a golfer as set forth in claim 17 farther comprising the steps of:

(e) unlocking the knee to permit unrestricted ambulation of the golfer's knee;

(f) selecting an additional knee flexion angle that may be the same or different than the optimum knee flexion angle selected in step (a);

(g) locking the knee at said additional knee flexion angle;

(h) approaching the ball in preparation for a golf swing; and (i) swinging the club through all phases of the golf swing.

19. The method for controlling and stabilizing the swing mechanics of a golfer as set forth in claim 17 wherein said optimum knee flexion angle is selected to be 30 degrees.

20. The method for controlling and stabilizing the swing mechanics of a golfer as set forth in claim 17 wherein optimum knee flexion angle is selected by considering the golfer's height, body-to-leg ratio, and arm length.

21. A method of controlling and stabilizing the swing of a golfer comprising the steps of:

(a) engaging a portion of a golfer's leg above the golfer's knee with an upper support member of an apparatus;

(b) engaging a portion of a golfer's leg below the golfer's knee with a lower support member of an apparatus; and (c) selecting one flexion angle out of a plurality of flexion angles by rotating a first structure of a hinge assembly of said apparatus with respect to a second structure of said hinge assembly, wherein the knee flexion angle is selected to be 30 degrees;

(d) locking the first structure of said hinge assembly with respect to the second structure of said hinge assembly at the selected one flexion angle thereby maintaining the knee of a golfer at a relatively constant flexion angle throughout the swing of a golfer.

22. A method of controlling and stabilizing the swing of a golfer as defined in claim 21 further comprising the steps of:

(e) unlocking the first structure of said hinge assembly with respect to the second structure of said hinge assembly thereby permitting unrestricted ambulation of the golfer's knee;

(f) selecting one flexion angle out of a plurality of flexion angles by rotating a first structure of a hinge assembly of said apparatus with respect to a second structure of said hinge assembly; and (g) locking the first structure of said hinge assembly with respect to the second structure of said hinge assembly at the flexion angle selected in step (f) thereby maintaining the knee of a golfer at a relatively constant flexion angle throughout the swing of a golfer.

23. A method of controlling and stabilizing the swing of a golfer comprising the steps of:

(a) engaging a portion of a golfer's leg above the golfer's knee with an upper support member of an apparatus;

(b) engaging a portion of a golfer's leg below the golfer's knee with a lower support member of an apparatus; and (c) selecting one flexion angle out of a plurality of flexion angles by rotating a first structure of a hinge assembly of said apparatus with respect to a second structure of said hinge assembly, wherein the step of selecting one flexion angle out of a plurality of flexion angles is performed by considering the golfer's height, body-to-leg ratio, and arm length; and (d) locking the first structure of said hinge assembly with respect to the second structure of said hinge assembly at the selected one flexion angle thereby maintaining the knee of a golfer at a relatively constant flexion angle throughout the swing of a golfer.

* * * * *